United States Patent [19]

Woo et al.

[11] Patent Number: 4,696,449

[45] Date of Patent: Sep. 29, 1987

[54] SECURITY DEVICE FOR ELECTRONIC EQUIPMENT

[75] Inventors: K. Woo, Toronto; Z. Mamak, Kettleby, both of Canada

[73] Assignee: The Board of Governors of Ryerson Polytechnical Institute, Toronto, Canada

[21] Appl. No.: 795,840

[22] Filed: Nov. 7, 1985

[51] Int. Cl.[4] ..... E05B 73/00

[52] U.S. Cl. ..... 248/553; 248/309.1; 248/499; 211/8

[58] Field of Search ..... 248/553, 551, 309.1, 248/499, 360, 147, 154, 1 A, 1 B, 346; 211/4, 8; 400/676; 70/231, 232, DIG. 57

[56] References Cited

U.S. PATENT DOCUMENTS

| | | | |
|---|---|---|---|
| 3,266,765 | 8/1966 | Campbell | 248/154 X |
| 3,559,962 | 2/1971 | Lucasey | 248/278 |
| 3,664,616 | 5/1972 | Raskin | 248/553 |
| 3,724,798 | 4/1973 | Lucasey | 248/418 |
| 3,913,880 | 10/1975 | Lucasey | 248/415 |
| 3,964,612 | 6/1976 | Skilliter, Jr. et al. | 248/309.1 X |
| 4,081,978 | 4/1978 | Ivey | 248/553 X |
| 4,170,334 | 10/1979 | Villanueva | 248/553 |
| 4,305,266 | 12/1981 | Lockwood | 248/553 X |
| 4,585,202 | 4/1986 | Parsekian | 248/553 |

OTHER PUBLICATIONS

"How Loyola Marymount Handles Computer Security" Harry R. Hueston, II, Campus Law Enforcement Journal.

"T-Track System", Trade Literature distributed by Holus Security Systems, Toronto.

"Anchor Pad", Trade Literature Distributed by Data Guard International Inc.

*IBM Technical Disclosure Bulletin,* "Security Frame for Monochrome and Color Monitors", Aug. 1985, vol. 28, No. 3, IBM Corporation.

*Primary Examiner*—Ramon S. Britts
*Assistant Examiner*—Karen J. Chotkowski
*Attorney, Agent, or Firm*—Ridout & Maybee

[57] ABSTRACT

A security device for personal computers, computer peripherals and similar valuable but readily portable units of equipment includes a tray secured to a working surface by bolts on which the unit is to be used, the tray being of a size to accommodate the unit and having front and back flanges and upward extension from its side walls to restrain the unit from horizontal movement without interference with its functions, the extensions being linked by a normally locked releasable cross bar placed so as to retain the unit in the tray covering the bolts, again without frictional interference with the unit. The tray of one device may be bolted to the cross bar of another security device, as when a monitor is stacked on a computer. The cross bar is preferably hinged to one upward extension and secured to the other by a tamper resistant screw, access to which is through a housing blocked by a removable lock plug and having an axis which is not coincident with that of the screw.

5 Claims, 6 Drawing Figures

SECURITY DEVICE FOR ELECTRONIC EQUIPMENT

The invention relates to security devices for valuable electronic equipment such as computers, typewriters and peripheral units used with computers.

The proliferation of such equipment in the workplace and in colleges and schools has resulted in a requirement for means to protect it against theft. Not only are the units themselves usually readily portable, but they often contain valuable and readily removable internal units such as circuit boards which are in themselves attractive to thieves, and are also vulnerable to tampering.

Desirable features of an antitheft device for such units include firstly the ability physically to prevent unauthorized removal of a unit from a location, and secondly the ability to prevent unauthorized access to the interior of the unit, whilst compromising neither the normal functions of the unit, nor obstructing its ventilation. Finally, the device should not be unduly visually obtrusive, although it is an advantage to render it apparent both that the unit is protected against theft and that the unit cannot be removed without serious damage, since such an appearance in itself provides threshold deterrence.

Devices have long been available for protecting television sets and other appliances in hotels and motels from theft, a leading manufacturer of such devices being Lucasey Mfg. Co., proprietor of U.S. Pat. Nos. 3,559,942, 3,724,798 and 3,913,880, all directed to antitheft stands for appliances, in which a member attached beneath the appliance is locked into a stand which is securely fastened to a supporting surface. In preferred arrangements, the member must be unlocked from the stand before access can be obtained to screws or bolts securing the member to the appliance and the stand to the supporting surface. More recently, devices assumed to operate similarly have been made available for computers, typewriters, printers and other office equipment.

Another device for the same purpose, marketed under the trade mark T-TRACK, applies a studded plate to the bottom of equipment to be protected, and a slotted 'maze plate' to a surface to which the equipment is to be secured. The equipment must be moved along a predetermined path with the aid of a map in order to reach a position in which the studs can be disengaged from the maze plate.

A system sold under the trade mark VERSA-LOCK utilizes a plate bonded to the base of the unit to be protected, and a short cable lock securing the plate to a fixed anchorage.

A system sold under the trade mark ANCHOR-PAD again has plates respectively bolted to the unit and bonded to a supporting surface, the plates being locked together by bars which are only accessible after removal of lock plugs.

Such systems as described, have two main shortcomings when applied to units such as computers, arising from their characteristic that attachment is to the bottom surface of the unit being protected. In their basic form they fail to protect the unit from tampering or the removal of internal units in those instances where covers can be removed whilst the unit is standing on its base. This applies to many popular personal computers. The VERSA-LOCK system apparently offers special tamper proof screws for securing such covers, but this entails that the protection is not intrinsic in the basic locking system. Furthermore, an increasing number of units have moulded plastic cases, which whilst adequate for their intended purpose may preclude an adequately strong anchorage to their under surface. Some systems endeavour to alleviate this problem by adhesively bonding a metal base plate to the unit, but it is difficult to select adhesives which provide adequate bonding and protection against release by the application of heat and/or piano wire type slicers, and at the same time are fairly readily removable by authorized persons. Much equipment also has ventilation slots or grilles in its base, which must not be obstructed.

We have found most units of the type discussed above have a basically quadrilateral prismatic form, and have a zone extending laterally across the top surface which does not require user access during normal use of the unit nor contain essential ventilation openings. By exploiting this zone it is possible to provide a security device which can both meet the requirements set forth above and does not require any physical attachment to the unit to be protected.

According to the invention, a security device for preventing unauthorized removal of a computer or peripheral unit comprises a tray having an upper surface of a size to accommodate the base of a unit to be protected, upstanding flanges at front and rear edges of the tray located to prevent substantial forward and rearward movement of a unit to be protected on the tray, releasable means to secure the tray to a supporting surface, said releasable securement means being accessible only from the upper surface of the tray, side plates extending upwardly from the lateral edges of the tray such as to flank portions of the end surfaces of the unit to be protected which are not required for user access or ventilation, a cross bar movable in an operative position extending between the side plates across a laterally extending zone of the upper surface of the unit which is not required for user access or maintenance, and means releasably locking said cross bar in said operative position with the side plates supporting the cross bar in a position in which it prevents vertical or tilting movement of the unit sufficient to disengage it from the upstanding flanges on the tray.

Preferably the locking device for the cross bar comprises a releasable fastening securing the cross bar to a side plate, and accessible only from within a housing itself secured by the fastening, and a lockable plug insertable in the housing to block access to the fastening. Preferably the fastening is a tamper resistant screw securing further brackets formed respectively on the cross bar and the side plate, the housing and lock plug are cylindrical, one end of the housing is located snugly within a recess defined by one of the brackets, and the screw is located eccentrically within the housing, whereby to prevent rotation of the housing within the recess.

Further features of the invention will become apparent from the following description of preferred embodiments thereof with reference to the accompanying drawings, wherein.

Figure 1:
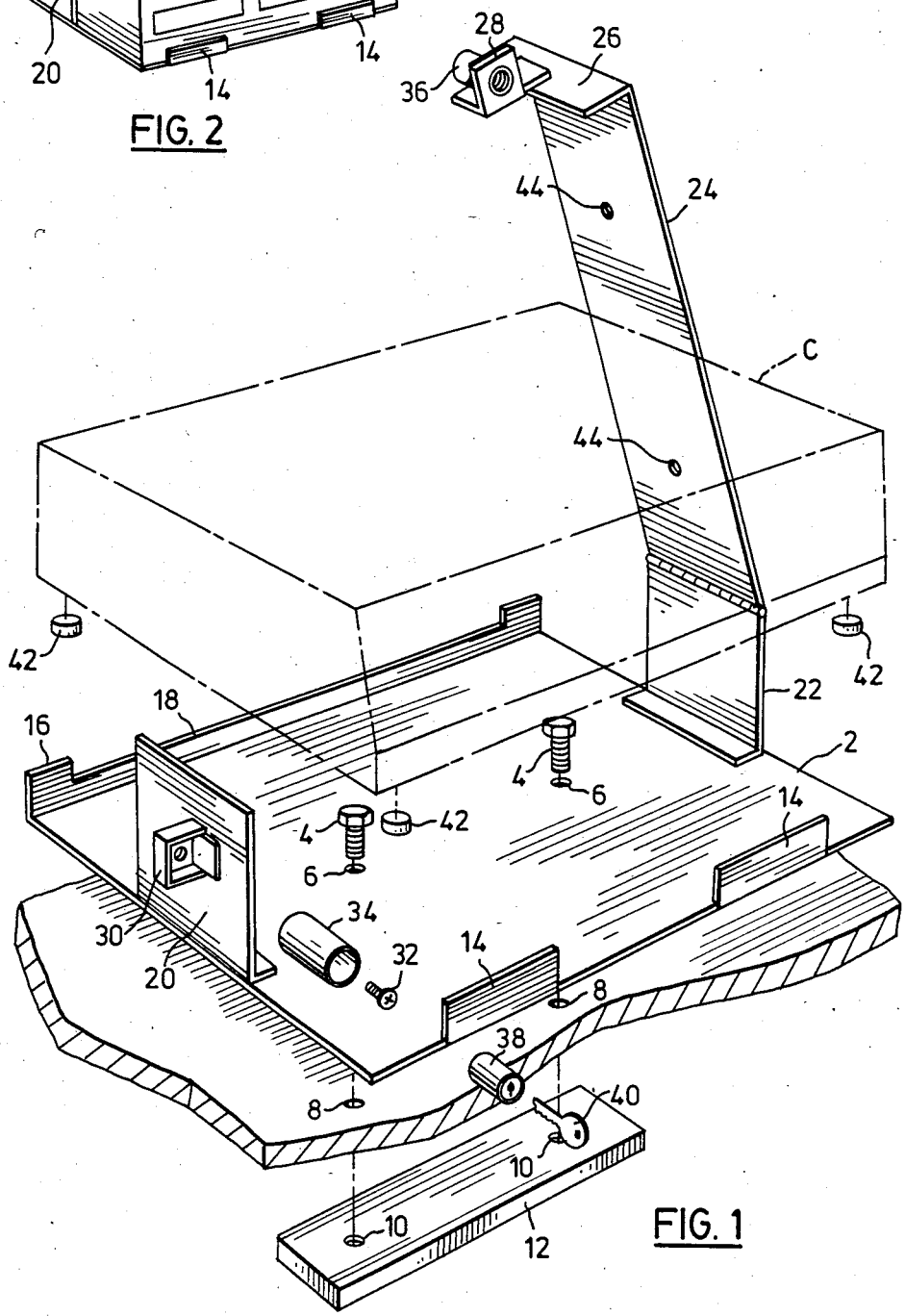
FIG. 1 is an exploded perspective view of a first embodiment of the invention suitable for securing a personal computer such as the IBM (trade mark) PC or similar unit.

Referring to FIG. 1, a security device, in this instance intended for an IBM PC or similar computer unit C, comprises a steel tray 2, having dimensions similar to the "footprint" of the computer unit C, which is secured to a desk top or other working surface by bolts 4, preferably two in number, passing through holes 6 in the trays and holes 8 drilled in the desk top and engaging threaded bores 10 in a steel bar 12 beneath the desk top. The length of the bolts should be selected so that they do not protrude below the bar when tightened. Although the method of securement entails drilling the desk top, it avoids the problems associated with the use of adhesives and is likely to do less damage to the desk top than would an effective adhesive. Since the bolts are accessible after, and only after, removal of the computer unit, authorized installation and removal of the device is simple, but unauthorized removal with the computer unit in place is believed extremely difficult without extensive damage to the unit or destruction of the desk.

The tray is provided with upstanding flanges 14 and 16 along its front and rear edges, which are designed to prevent forward or rearward movement of the unit C, without any interferences with the functions of the latter. Thus the front flanges 14 are low enough not to project in front of a front ventilation grille G or disk drive units D whilst the rear flange is cut away at 18 along its top edge to prevent any obstruction to sockets and cables at the rear of the unit. Side plates 20 and 22 extend the height of the unit, and lie adjacent its sides to prevent lateral movement of the latter, whilst a cross bar 24 is hinged to the plate 22 and in a closed position (see FIG. 2) lies flat on the top surface of the unit C with a downturned end portion 26 overlying the plate 20 so that a bracket 28 on the end portion abuts a bracket 30 on the plate 20. The brackets are secured together by a screw 32 passing through the bottom of a cylindrical housing 34 and the two brackets 28 and 30 into a socket 36, in a manner described in more detail below with reference to FIGS. 5 and 6, a lock cylinder 38 being locked into the housing 34 by a key 40 to block access to the screw. The device is a snug enough fit around the device that the unit C cannot be lifted from the tray sufficiently for either the unit or its cover to be withdrawn over the flanges 14 to 16, or to enable the bolts 4 to be unscrewed sufficiently to release the bar 12, even supposing that they can be reached with a wrench. In order to prevent the bolt heads damaging the bottom of the computer, rubber feet 42 are adhered to the latter to provide a small amount of clearance over the tray. A fairly snug fit of the side plates 20 and 22 and the cross bar 24 against the case of the unit C is desirable to somewhat limit the visual obtrusiveness of the security device, which for the same reason is finished in a colour matching that of the unit. For reasons already pointed out, some visible evidence of the presence of the device is desirable because of its deterrent effect. As will be discussed further below, a small clearance is provided between the bar 24 and the unit C, and the bar is formed with spaced holes 44. Since the cover of units such as C is usually free of ventilation openings or other features requiring free access, the device of the invention does not interfere with normal use of the unit.

Figure 2:
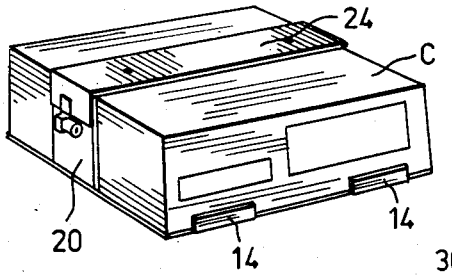
FIG. 2 shows the same unit, on a similar scale and in an assembled condition.
Figure 3:
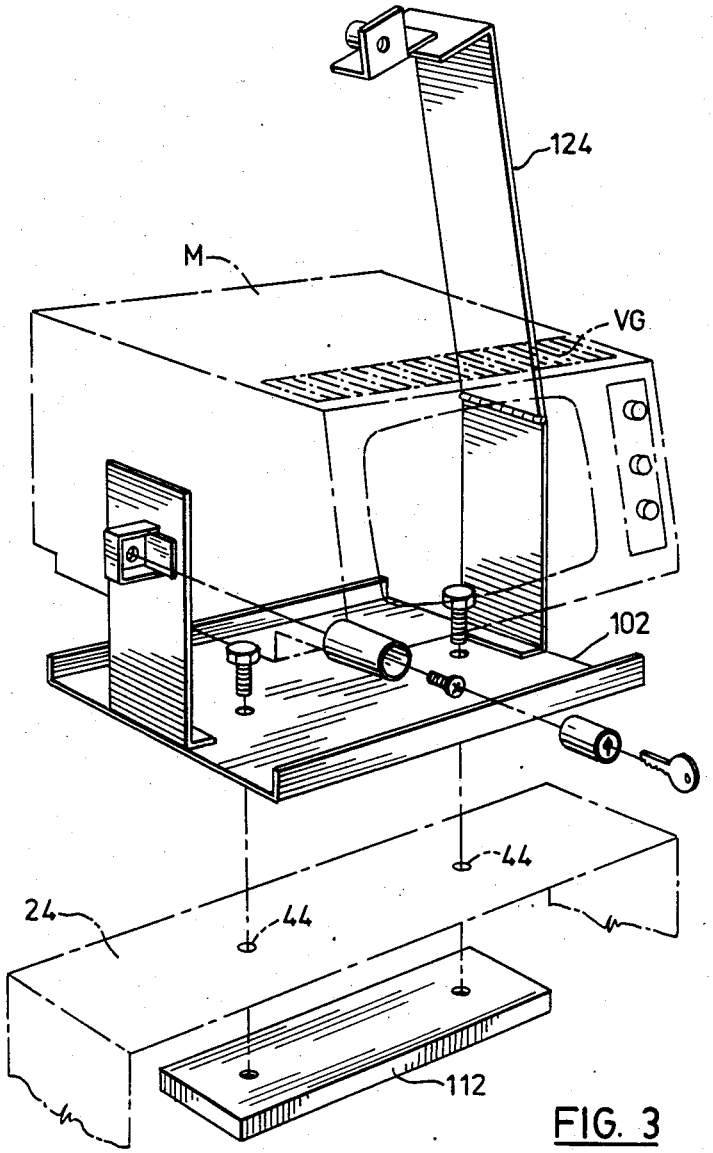
FIG. 3 illustrates a second embodiment, suitable for securing a monitor.

FIG. 3 shows a similar device intended for use in conjunction with a monitor unit M, similar parts being designated by the same reference numerals as in FIGS. 1 and 2, incremented by 100. It will be noted that the bar 124 is located so as not to obstruct a ventilation grille G in the top of the monitor M. The holes 44 provided in the cross bar 24 of the security device of FIGS. 1 and 2 enable the device of FIG. 3 to be installed, as is common practice, on top of the computer unit C, although in this instance the cross bar 24 provides the working surface, the bar 112 being installed between the bar 24 and the top of unit C.

Figure 4:
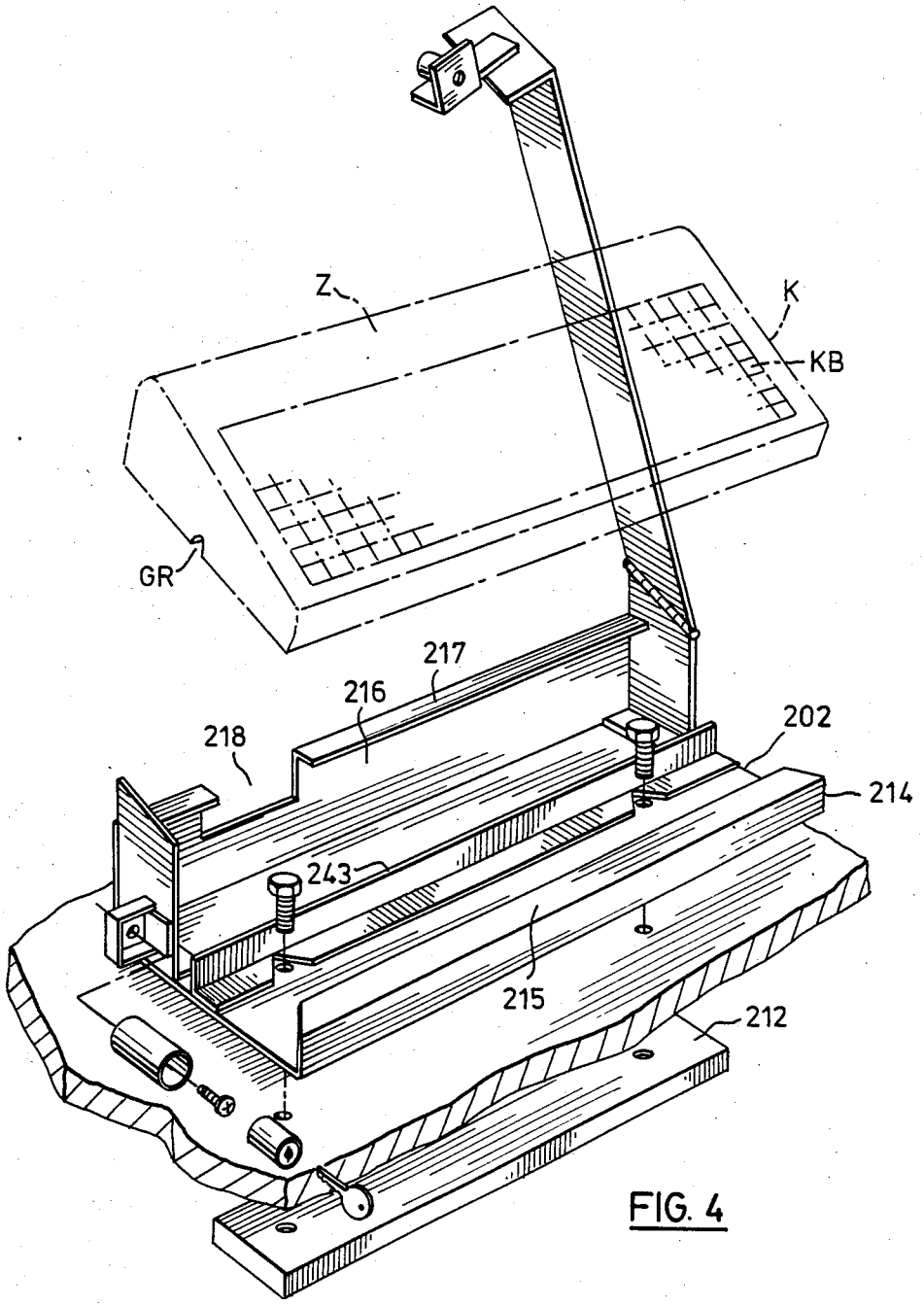
FIG. 4 illustrates a third embodiment suitable for securing a keyboard unit.

FIG. 4 shows a further embodiment intended for use in conjunction with a keyboard unit K. Parts similar to those of the FIGS. 1 and 2 embodiment are similarly numbered, with an increment of 200. In such a unit, a major portion of the upper surface will be occupied by the actual keyboard KB, but there will normally be an unobstructed zone Z along the rear of the upper surface. The flange 214 of the front of the device has an inturned lip 215 to overlap the front edge of the top of the keyboard and prevent its lifting, whilst the flange 216 also has an inturned lip 217 which rests against the rear of the keyboard, with a cutout 218 permitting passage of a keyboard cable. The keyboard is supported at a suitable angle on the tray 202 by a laterally extending flange 243 which engages a groove GR in the base of the keyboard unit. The cross bar 224 extends across the zone Z at the rear of the unit without obstructing the keyboard proper.

From the foregoing description, it will be understood that the constructional principles of the device are adaptable to provide security for a range of different units without significantly restricting the functionality of the latter. Obviously, variations in dimensions and proportions will be necessary to accommodate different units but it is believed that devices having the features set forth in the appended claims can be configured to accommodate the great majority of major units of computer and related equipment presently available.

Figures 5, 6:
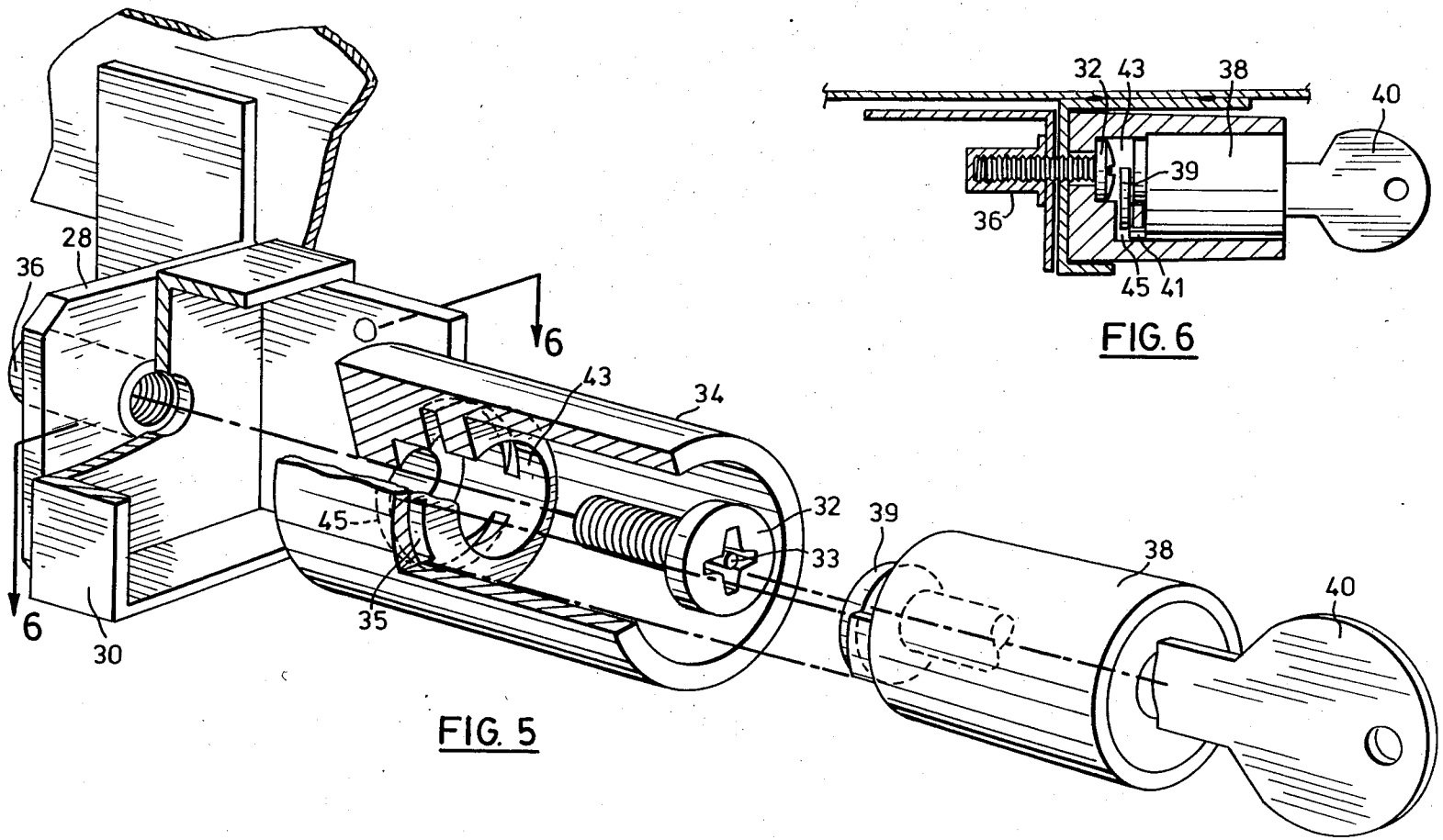
FIG. 5 is a detail on an enlarged scale and partly broken away, illustrating the locking mechanism utilized.
FIG. 6 is a section through the locking mechanism on the line 6—6 in FIG. 5.

The locking arrangement used in each of the units described above is shown in more detail in FIGS. 5 and 6. The devices are maintained in their closed condition by the screw 32 which clamps the brackets 28 and 30 closely together thus making it difficult to jimmy them apart, whilst the basic structure of the device is difficult to disrupt by force without serious damage to the unit captive within it. The threaded portion of the screw is protected by lugs received within the socket 36 which is welded to the bracket 28, whilst the head of the screw is enclosed within the housing 34, access to it being blocked by the lock plug 38 which must be removed to obtain access to the screw head. As best seen in FIG. 6, the screw is located eccentrically within the housing 34, which in turn is located snugly between flanges 31 on the bracket 30. The flanges thus prevent the housing from being rotated on the bracket 30 to loosen the screw. The screw itself is preferably of a tamper proof variety requiring a special screwdriver for insertion or release. The screw shown is of the Phillips type with the addition of a central pin 33 preventing engagement except by a screwdriver having a complementary central bore, but other types of screws could be utilized. The lock cylinder 38 as shown is a conventional cylinder lock having an eccentric cam 39 at its inner end controlled by a key 40, and a locating spigot 41 which enters a recess 35 in the housing to prevent rotation of the plug. When the plug is inserted in the housing with the spigot 41 entering the recess 35 and the key in an unlocked position the cam 39 enters a bore 43 and can be turned with the key to interlock with a groove 45 in the bore 4. It will be understood that other forms of lock cylinder and other arrangements for engaging the cylinder with the housing could be utilized, depending upon the degree of security required.

It will also be understood that the connections of the side members and cross bar may be different from those described. Thus the cross bar 24 could be integral with the side member 22, with the latter hinged to the tray, or the hinge could be replaced by some alternative form of interengagement of the parts which prevents their separation when the bar 24 is locked in place. Furthermore, the locking means for the bar could be differently located. The basic requirement is that the side members and cross bar should cooperate with the locking device to form a releasable girdle around the unit to be protected which holds the unit securely in the tray.

We claim:

1. A security device for preventing unauthorized removal of a computer or peripheral unit, comprising a tray having a bottom wall with an upper surface of a size to provide distributed support to the base of a single unit to be protected; upstanding flanges at front and rear edges of the bottom wall of the tray, said flanges being located to prevent substantial forward or rearward movement of the unit to be protected when standing on the bottom of the tray; releasable securement means to secure a lower surface of the bottom wall of the tray in tight engagement with a support member, said releasable securement means comprising a plate beneath the support member and extending in a plane parallel to the bottom wall of the tray, and a plurality of screws having threaded shanks extending downwardly from heads engaging the upper surface of the bottom wall of the tray, through the bottom wall of the tray and the support member, and having lower ends received in threaded bores in the plate, the screw heads being accessible only from the upper surface of the tray; side plates extending upwardly from the lateral edges of the tray such as to flank closely portions of the end surfaces of the unit to be protected which are not required for user access or ventilation; a crossbar hinged to one of said side plates and movable to an operative position extending between the side plates closely adjacent a zone extending laterally across a full width of an upper surface of the unit which is not required for user access or maintenance; and means releasably locking said crossbar in said operative position, with the side plates supporting the crossbar to form with the bottom wall of the tray a releasable girdle having an internal perimeter not substantially greater than the external perimeter of the unit in the plane of the girdle, whereby the girdle embraces the unit sufficiently closely to prevent disengagement of the latter from the upstanding flanges on the tray.

2. A device according to claim 1, wherein the means releasably locking the crossbar comprises a releasable fastening securing the crossbar to a side plate, a housing itself secured by the releasable fastening to the side plate, the fastening being accessible only from within the housing, and a lockable plug insertable in the housing to block access to the fastening.

3. A device according to claim 2, wherein the releasable fastening is a tamper resistant screw securing further brackets formed respectively on the crossbar and the side plate, the housing and the lockable plug are cylindrical, the lock plug is insertable in one open end of the housing, a second closed end of the housing is located snugly within a recess defined by one of the brackets, and the screw passes through a bore in the closed end of the housing, which bore is located eccentrically within the housing to prevent rotation of the housing within the recess.

4. A combination of dissimilar devices according to claim 1, wherein the crossbar of a first such device of said combination, to receive a computer unit, is drilled to form a support member for a second such device of said combination, to receive a monitor unit, said support member of the first device receiving releasable securement means of said second device, the bottom tray of which is held in tight engagement with the crossbar.

5. A combination according to claim 4, wherein the combination further includes a third such device, to receive a keyboard, in which device the side plates are adjacent the rear of the tray, the front flange of the tray is inturned to overlie a front edge portion of a top surface of the keyboard, and the crossbar is located so that a rear edge portion of the upper surface of the keyboard will lie beneath the crossbar.

* * * * *